US009117603B2

(12) United States Patent
Hwa

(10) Patent No.: US 9,117,603 B2
(45) Date of Patent: Aug. 25, 2015

(54) ILLUMINATED KEYBOARD EQUIPPED WITH A THIN KEY MODULE

(71) Applicant: ZIPPY TECHNOLOGY CORP., New Taipei (TW)

(72) Inventor: Chin-Hsiu Hwa, New Taipei (TW)

(73) Assignee: ZIPPY TECHNOLOGY CORP., New Taipei (TW)

( * ) Notice: Subject to any disclaimer, the term of this patent is extended or adjusted under 35 U.S.C. 154(b) by 178 days.

(21) Appl. No.: 14/035,318

(22) Filed: Sep. 24, 2013

(65) Prior Publication Data

US 2015/0034468 A1 Feb. 5, 2015

Related U.S. Application Data

(63) Continuation-in-part of application No. 13/956,066, filed on Jul. 31, 2013.

(51) Int. Cl.
*H01H 13/7065* (2006.01)
*H01H 13/83* (2006.01)

(52) U.S. Cl.
CPC ..... *H01H 13/7065* (2013.01); *H01H 13/83* (2013.01)

(58) Field of Classification Search
CPC ..... H01H 3/7065
USPC ..... 200/5 A, 314, 341, 344–345, 520; 400/490–496
See application file for complete search history.

(56) References Cited

U.S. PATENT DOCUMENTS 5,329,084 A * 7/1994 Watanabe et al. ..... 200/344
6,217,183 B1 4/2001 Shipman
6,388,219 B2 5/2002 Hsu et al.
6,509,536 B2 * 1/2003 Sasaki ..... 200/344
7,154,059 B2 12/2006 Chou
7,239,303 B2 7/2007 Liao et al.
7,319,202 B2 * 1/2008 Sato et al. ..... 200/344
7,504,596 B2 3/2009 Chou
7,628,500 B2 12/2009 Chou
7,939,773 B2 5/2011 Tsai
8,173,922 B2 * 5/2012 Chen ..... 200/314

(Continued)

FOREIGN PATENT DOCUMENTS

TW 445471 B 7/2001
TW I220213 B 8/2004

(Continued)

*Primary Examiner* — Edwin A. Leon

(74) *Attorney, Agent, or Firm* — Muncy, Geissler, Olds & Lowe, P.C.

(57) ABSTRACT

An illuminated keyboard is equipped with a thin key module which includes a support frame with multiple keycap installation apertures and multiple keycaps corresponding to the keycap installation apertures. Each keycap has at least three movable arms each is connected between the first wall of one side of the keycap and the second wall of the keycap installation aperture. The support frame, keycaps and movable arms are integrally formed by injection. The movable arm has a first connecting section connected to the keycap and a second connecting section connected to the first connecting section at a first bend spot. The second connecting section is extended between the keycap and support frame and connected to the keycap installation aperture. In the illuminated keyboard, light is generated by a lighting unit and transmitted through a light guide plate or light guide circuit board to project to the keycaps for illumination.

26 Claims, 12 Drawing Sheets

(56) References Cited

U.S. PATENT DOCUMENTS

| | | | |
|---|---|---|---|
| 8,184,021 | B2 | 5/2012 | Chou |
| 8,292,444 | B2 | 10/2012 | Lin et al. |
| 8,319,130 | B2 | 11/2012 | Lee et al. |
| 2013/0126324 | A1 | 5/2013 | Chiang et al. |

FOREIGN PATENT DOCUMENTS

| | | | |
|---|---|---|---|
| TW | M346861 | U | 12/2008 |
| TW | M426075 | U | 4/2012 |
| TW | M434979 | U | 8/2012 |

* cited by examiner

ILLUMINATED KEYBOARD EQUIPPED WITH A THIN KEY MODULE

This application is a continuation-in-part, and claims priority, of from U.S. patent application Ser. No. 13/956,066 filed on Jul. 31, 2013, entitled "KEYCAP MODULE FABRICATED BY INTEGRATED INJECTION", the entire contents of which are hereby incorporated by reference.

FIELD OF THE INVENTION

The present invention relates to an illuminated keyboard and particularly to an illuminated keyboard with an integrally formed keyboard portion to facilitate assembly.

BACKGROUND OF THE INVENTION

There are numerous types of keyboard products on the market in response to different consumer requirements. Many producers also provide illuminated keyboards with integrated lighting modules to generate illumination effect to attract consumers and increase consumers' purchase desire. While providing illumination function is important, trying to improve the structural design to reduce the total thickness of the keyboard module also is a heavy focus of the producers so that it can be widely adopted on notebook computers or desktop computers that highlight thinner and lighter design.

A conventional illuminated keyboard such as those disclosed in U.S. Pat. Nos. 8,319,130, 7,939,773 and 6,217,183 generally includes a keycap, a circuit board triggered by the keycap to generate a command signal, a baseboard located at one side of the circuit board and a driven mechanism with two ends connecting to the keycap and baseboard. In the aforesaid illuminated keyboard, the keycap is pressed by a force to move toward the circuit board, and the driven mechanism is also compressed downwards to trigger and set on a circuit switch on the circuit board to generate a corresponding control signal. When the force pressing the keycap is absent, the driven mechanism provides a return elastic force to push the keycap to move away from the circuit board at a selected elevation. As the driven mechanism always is formed at a certain thickness, even it is compressed when being driven by the keycap, it still has a certain height. Hence the driven mechanism becomes a constraint that makes slimness of the illuminated keyboard difficult.

In order to overcome the problem caused by the driven mechanism, some producers have proposed other keyboard designs. For instance, Taiwan utility model No. M434979 discloses a design which has a first support member and a second support member coupled to form a V-shaped structure to overcome the thickness problem caused by the conventional driven mechanism that adopts an X-shaped structure. Although the structure disclosed in this prior art can reduce the thickness of the illuminated keyboard, it utilizes the driven mechanism only in another form, hence still has limited effect on slimness of the keyboard. Moreover, deployment of the first and second support members makes assembly of the keyboard more difficult and requires more assembly steps.

SUMMARY OF THE INVENTION

The primary object of the present invention is to overcome the thickness problem of the conventional illuminated keyboards.

To achieve the foregoing object, the invention provides an illuminated keyboard which comprises a thin key module, a light guide circuit board and a baseboard. The thin key module includes a support frame with a plurality of keycap installation apertures and a plurality of keycaps corresponding to the keycap installation apertures. Each keycap has four sides and four corners. Each side and each keycap installation aperture have respectively a first wall and a second wall. Each keycap has at least three movable arms each is connected between the first wall and the second wall. The keycaps, movable arms and support frame are integrally formed by injection. Each movable arm has a first connecting section connected to one corner of each keycap and a second connecting section connected to the first connecting section at a first bend spot. The second connecting section is extended towards a neighboring corner of the keycap and connected to the second wall of the keycap installation aperture. The light guide circuit board is located below the thin key module and has an upper light guide portion and a lower light guide portion. The upper and lower light guide portions have respectively a first circuit layer and a second circuit layer facing each other. The first and second circuit layers are interposed by a command trigger switch corresponding to each keycap. The upper light guide portion has a first mask layer opposite to the first circuit layer. The lower light guide portion has a second reflective layer opposite to the second circuit layer. The first mask layer and second reflective layer form an optical channel between them. The first mask layer has at least one transparent zone corresponding to the keycap to allow light transmitted in the optical channel to project to the keycap. The baseboard is located correspondingly to the light guide circuit board.

In one embodiment the upper light guide portion has a first reflective layer located below the first mask layer. In addition, the lower light guide portion has a second mask layer located below the second reflective layer.

In another embodiment the light guide circuit board has a spacer located between the upper light guide portion and lower light guide portion. The spacer has an opening corresponding to each command trigger switch.

In yet another embodiment the light guide circuit board is located above the baseboard.

In yet another embodiment the light guide circuit board is located below the baseboard.

In yet another embodiment the movable arm has a third connecting section connected to the second connecting section at a second bend spot and also connected to the second wall of the keycap installation aperture.

Aside from the aforesaid embodiment the invention also provides another embodiment in which the illuminated keyboard comprises a thin key module, a light guide plate, a circuit board and a baseboard. The thin key module includes a support frame with a plurality of keycap installation apertures and a plurality of keycaps corresponding to the keycap installation apertures. Each keycap has four sides and four corners. Each side and each keycap installation aperture have respectively a first wall and a second wall. Each keycap has at least three movable arms each is connected between the first wall and the second wall. The keycaps, movable arms and support frame are integrally formed by injection. Each movable arm has a first connecting section connected to one corner of each keycap and a second connecting section connected to the first connecting section at a first bend spot. The second connecting section is extended towards a neighboring corner of the keycap and connected to the second wall of the keycap installation aperture. The light guide plate is located below the thin key module and has a plurality of transparent zones corresponding to the keycaps. The light guide plate receives light from a lighting unit and allows the light to project to the keycaps through the transparent zones. The circuit board is located correspondingly to the light guide plate and has a plurality of command trigger switches each corresponding to one keycap and being triggered to generate a keyboard signal. The baseboard is located correspondingly to the circuit board.

In one embodiment the circuit board is located below the light guide plate, and the baseboard is located below the circuit board. Furthermore, the light guide plate has a plurality of connection apertures located in the transparent zones and corresponding to the command trigger switches. In addition, the light guide plate has a mask layer located at one side thereof facing the thin key module to allow the light guide plate to have the transparent zones and opaque zones. The circuit board has a reflective layer located at one side thereof facing the baseboard to reflect light to the light guide plate.

In another embodiment the circuit board is located above the light guide plate, and the baseboard is located between the circuit board and light guide plate. Furthermore, the baseboard has a plurality of light guide apertures corresponding to the command trigger switches. The circuit board has a plurality of hollow-out zones corresponding to the keycaps. In addition, the circuit board has a mask layer located at one side thereof facing the thin key module and containing the transparent portions corresponding to the keycaps and opaque portions connected to the transparent portions. The light guide plate further has a reflective layer located at one side thereof remote from the baseboard.

In yet another embodiment the circuit board is located below the baseboard. The light guide plate is located below the circuit board. Furthermore, the baseboard has a plurality of light guide apertures corresponding to the keycaps. The circuit board has a plurality of hollow-out zones corresponding to the keycaps. The light guide plate further has a reflective layer located at one side thereof remote from the circuit board.

In yet another embodiment the movable arm has a third connecting section connected to the second connecting section at a second bend spot and connected to the second wall of the keycap installation aperture.

The illuminated keyboard quipped with a thin key module thus formed, compared with the conventional illuminated keyboards, provides features as follows:

1. The illuminated keyboard can be made thinner. In the invention the thin key module supports each keycap through the movable arms which are located at the same plane of the keycap. Such a structure can overcome the constraint of the conventional keyboard that employs the driven mechanism, thus can resolve the problem caused by the keyboard thickness.

2. Simplified production and assembly. The thin key module of the invention is integrally formed by injection. Assembly can be accomplished by coupling the thin key module with the baseboard or light guide plate, hence can simplify the complicated process during assembly of the driven mechanism in the conventional keyboards The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
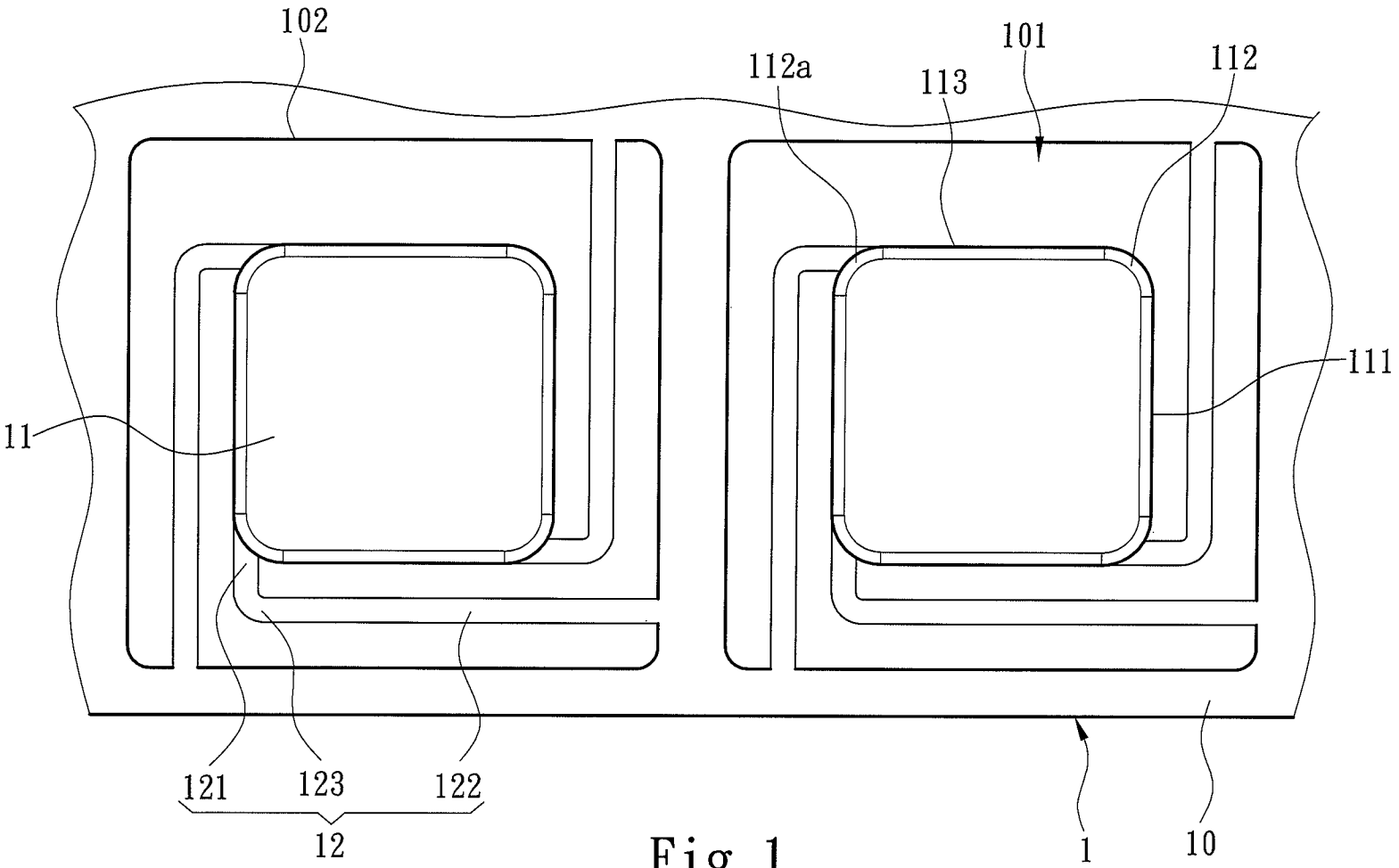
FIG. 1 is a top view of a first embodiment of the thin key module of the invention.
Figure 2:
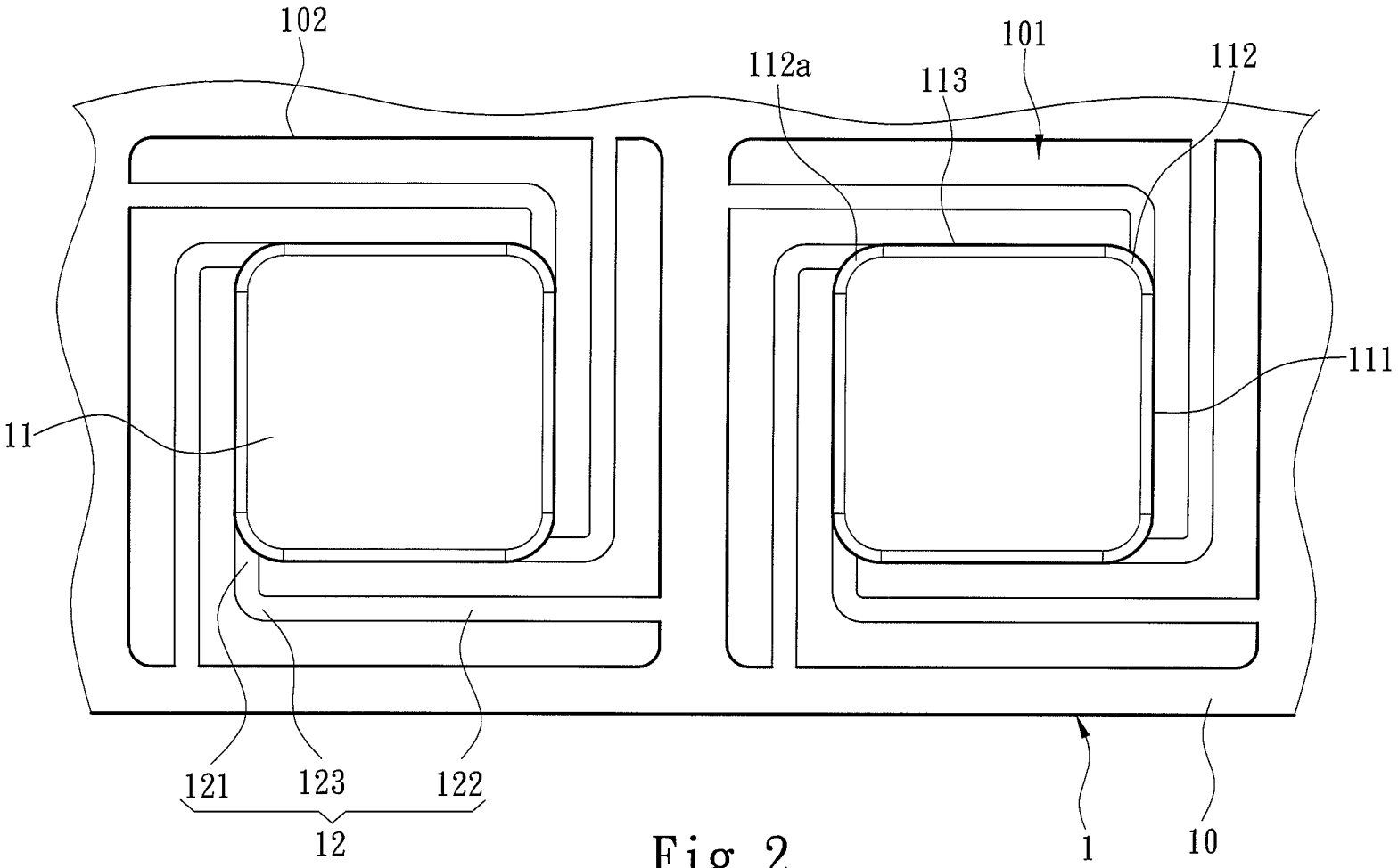
FIG. 2 is a top view of a second embodiment of the thin key module of the invention.
Figure 3:
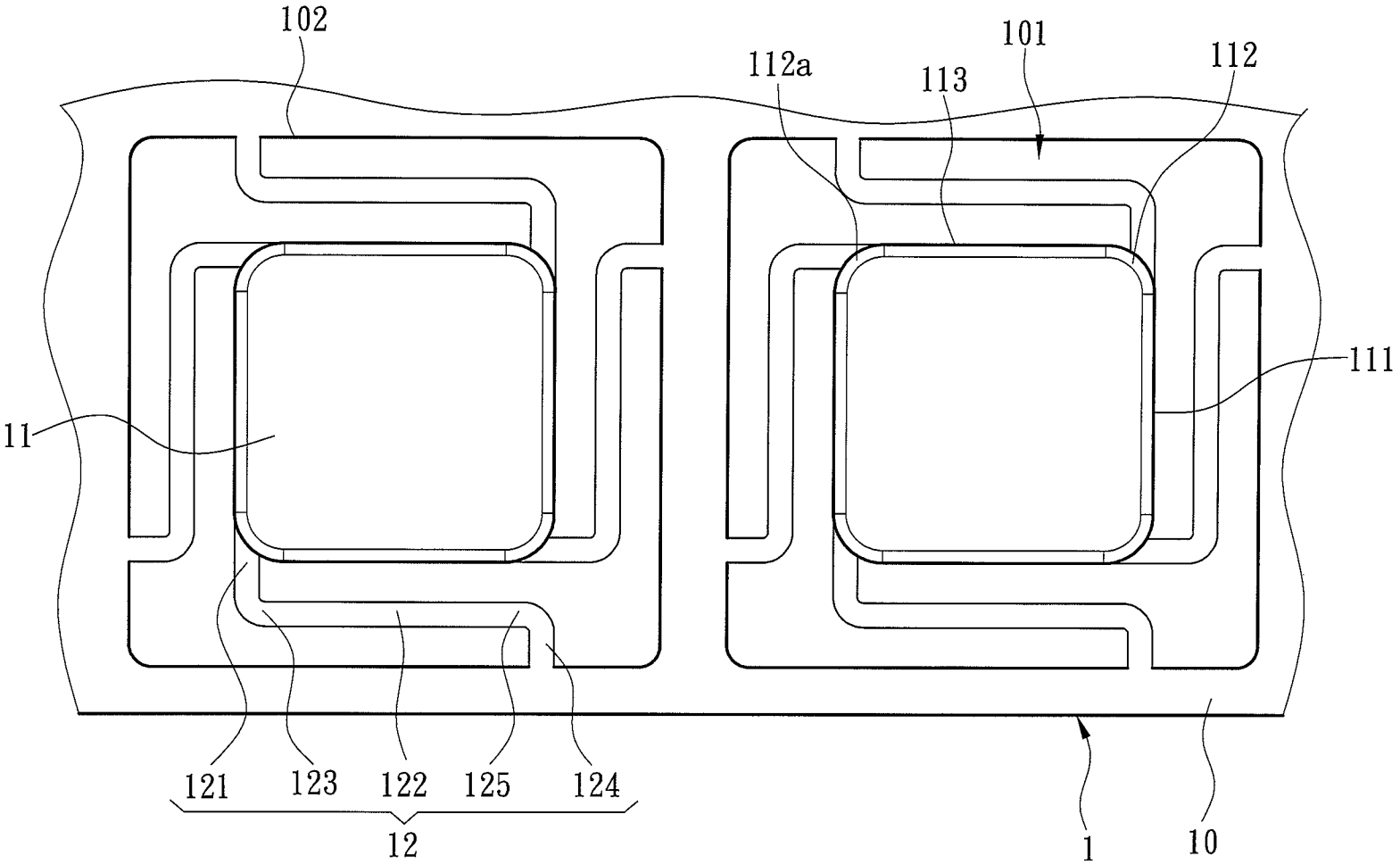
FIG. 3 is a top view of a third embodiment of the thin key module of the invention.
Figure 4:
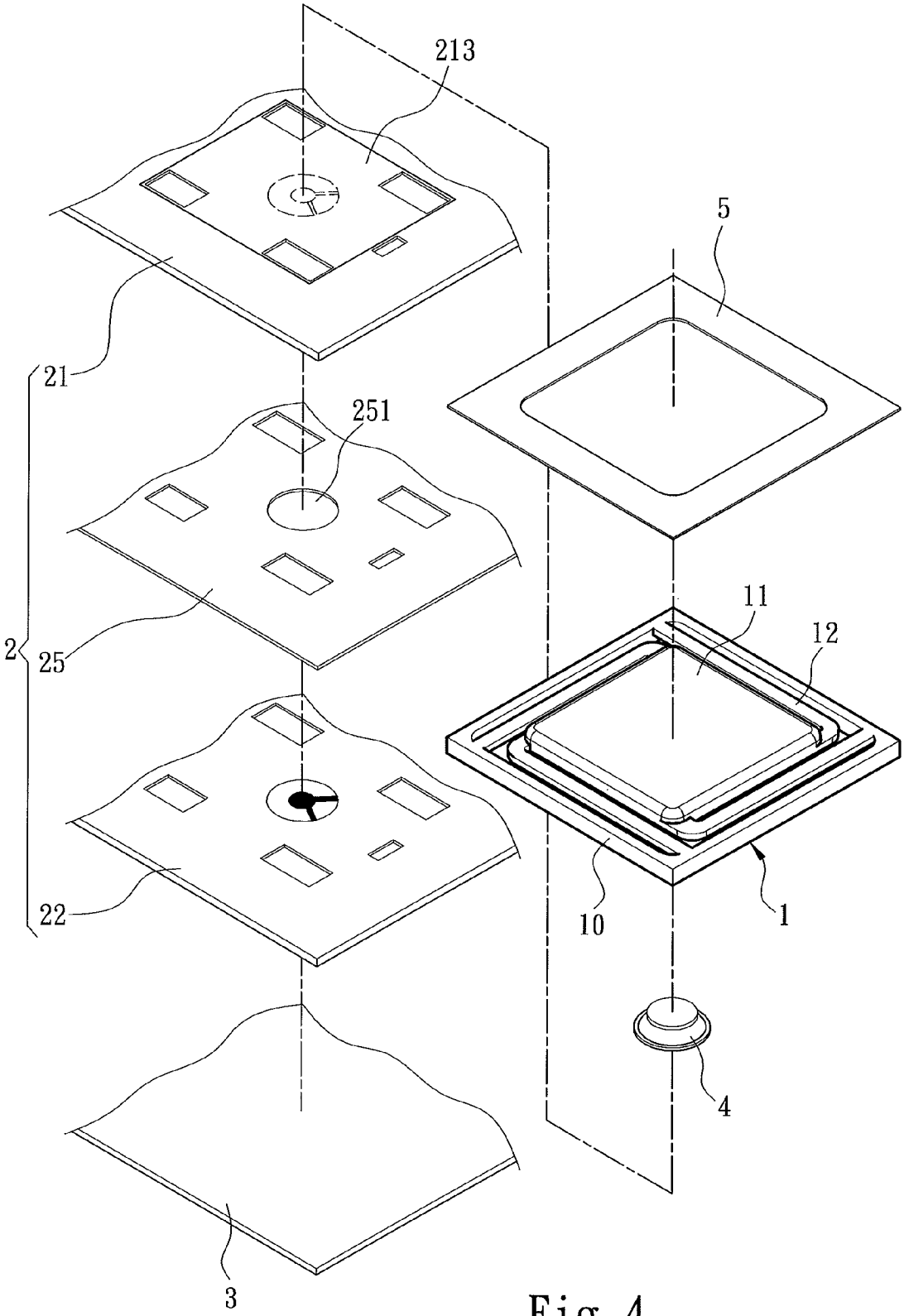
FIG. 4 is an exploded view of a second embodiment of the illuminated keyboard according to the invention.
Figure 5A:
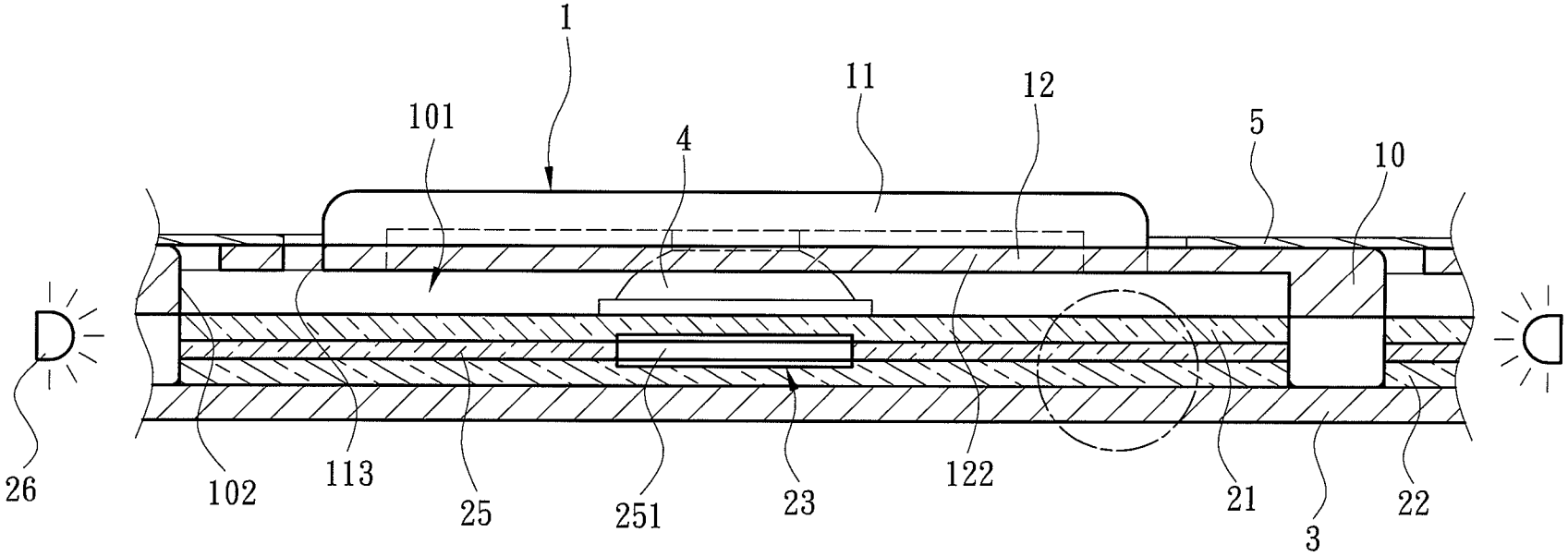
FIG. 5A is a side view of the second embodiment of the illuminated keyboard according to the invention.
Figure 5B:
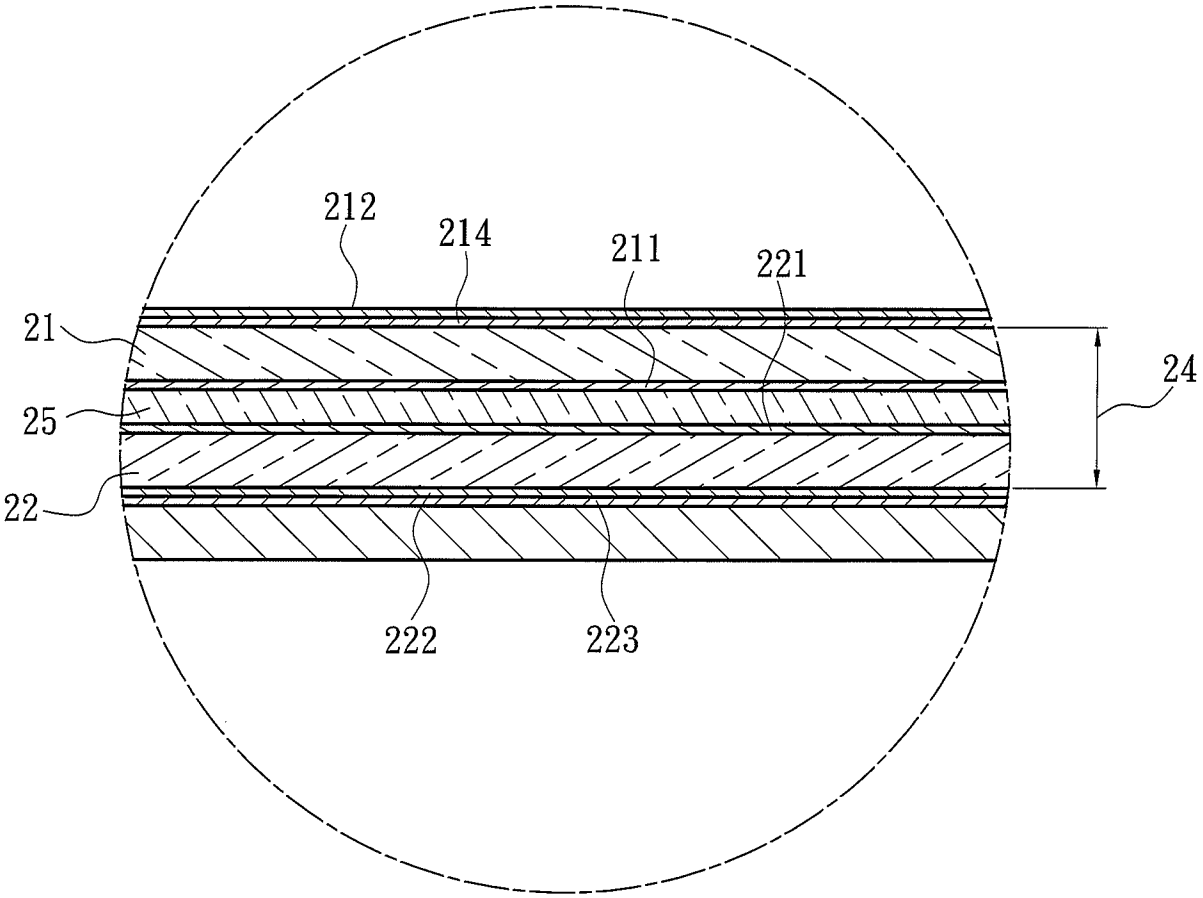
FIG. 5B is a fragmentary enlarged view according to FIG. 5A.
Figure 6:
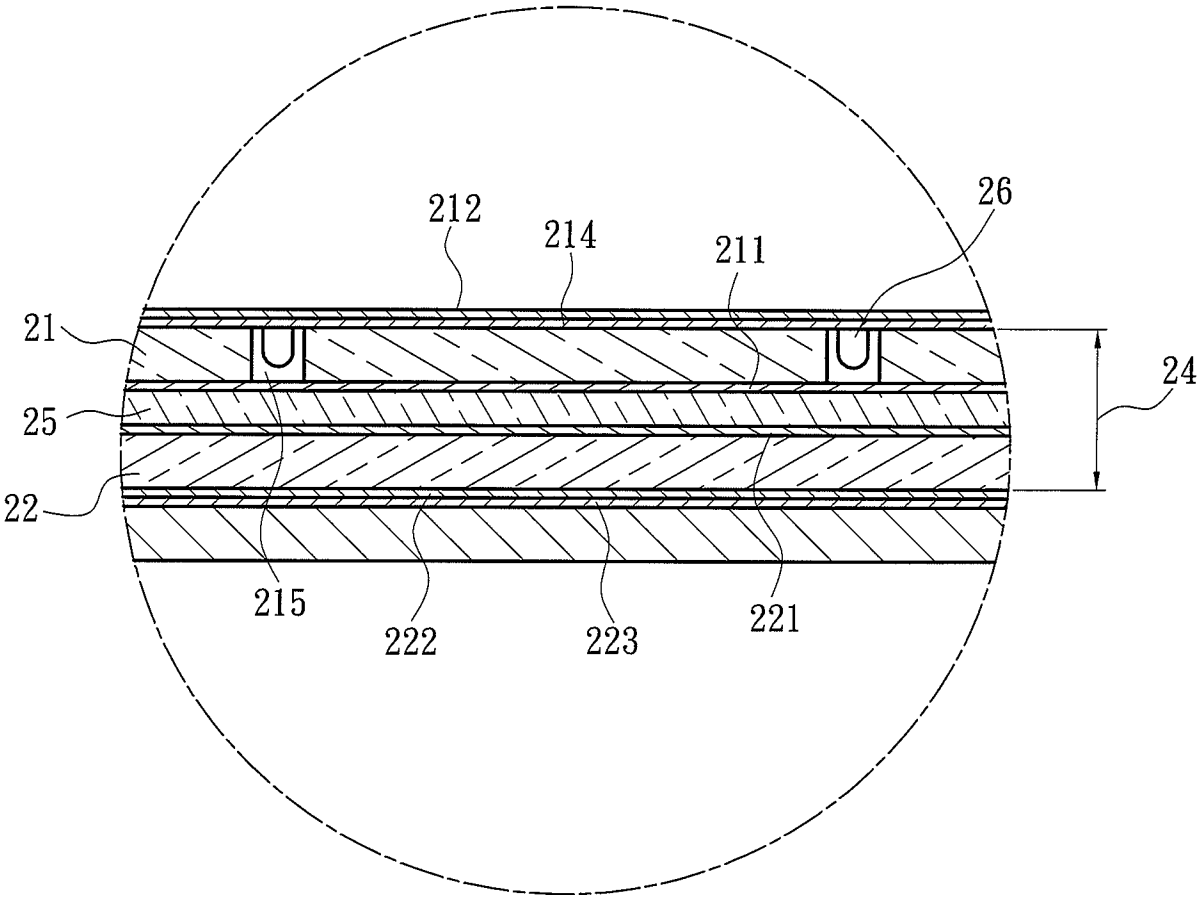
FIG. 6 is a side view of a third embodiment of the illuminated keyboard according to the invention.
Figure 7:
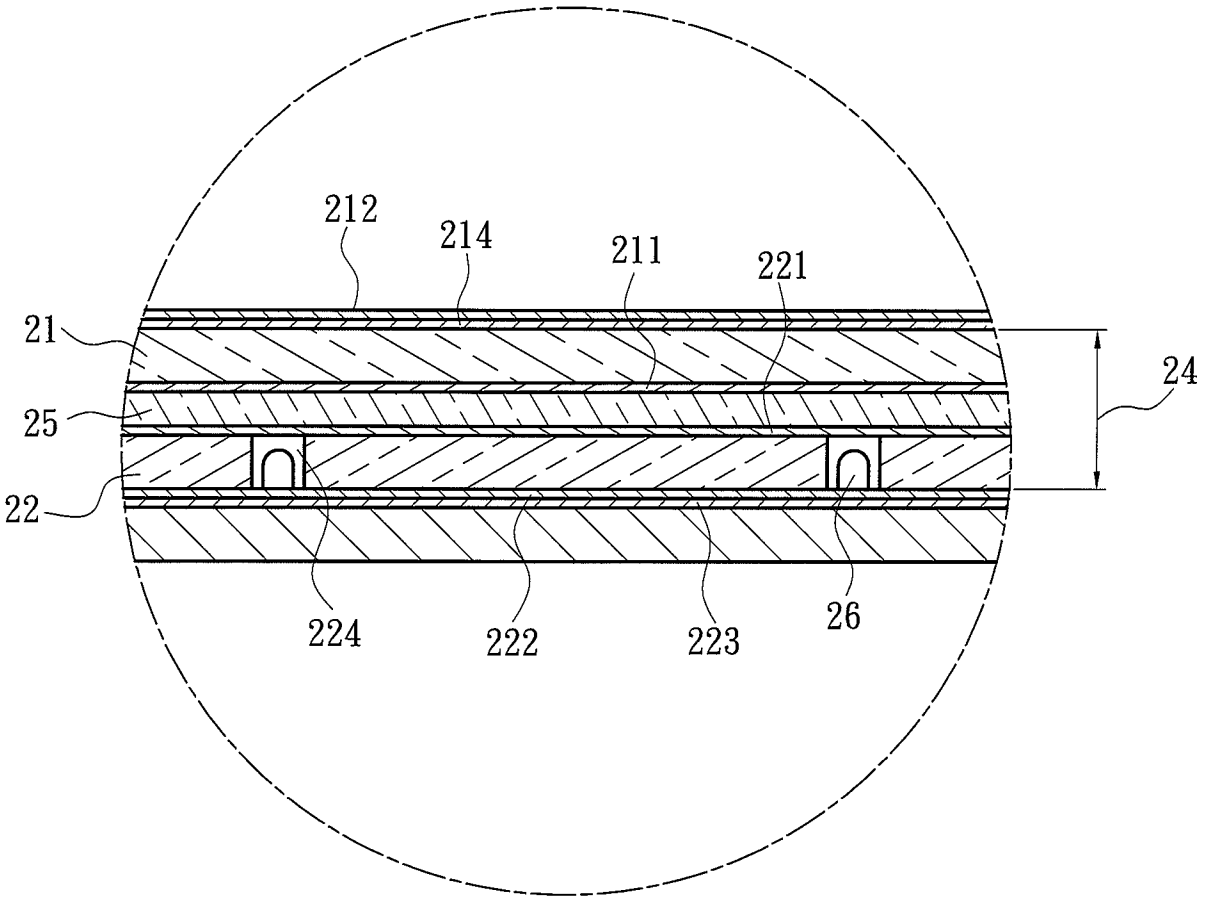
FIG. 7 is a side view of a fourth embodiment of the illuminated keyboard according to the invention.

Please refer to FIG. 1, the present invention aims to provide an illuminated keyboard equipped with a thin key module 1. The thin key module 1 includes a support frame 10 and a plurality of key caps 11. The support frame 10 has a plurality of keycap installation apertures 101 each holds a keycap 11. Each keycap 11 has four sides 111 and four corners 112. Each side 111 and each keycap installation aperture 101 have respectively a first wall 113 and a second wall 102. Each keycap 11 has at least three movable arms 12 each is connected between the first wall 113 and the second wall 102. The thin key module 1 is integrally formed by injection. Namely, the support frame 10, keycaps 11 and movable arms 12 are integrally formed by injection. More specifically, each movable arm 12 has a first connecting section 121 and a second connecting section 122. The first connecting section 121 is extended from one corner 112 of each key cap 11. The second connecting section 122 is connected to the first connecting section 121 through a first bend spot 123 and extended towards a neighboring corner 122*a* of the keycap 11 and connected to the second wall 102 as shown in FIG. 1. Aside from making the movable arm 12 as previously discussed, to meet the requirements of different feedback tactile feel in operation, the design of the movable arm 12 can be changed as depicted in another embodiment shown in FIG. 2. In which, each keycap 11 can have four movable arms 12 respectively on the four sides 111 thereof, and each movable arm 12 is connected between the first wall 113 and the second wall 102. Moreover, in addition to the first and second connecting sections 121 and 122, referring to FIG. 3, a third connecting section 124 is provided to connect to the second connecting section 122 at a second bend spot 125 and extend towards the second wall 102 to connect to the second wall 102. It is to be noted that the embodiment shown in FIG. 2 is used for discussion hereafter, but it is not limited to the invention.

The illuminated keyboard of the invention generates light mainly according to the following embodiments. One of them, please referring to FIGS. 4 through 7, includes a light guide circuit board 2 and a baseboard 3. The light guide circuit board 2 is located below the thin key module 1 and has an upper light guide portion 21 and a lower light guide portion 22. The upper and lower light guide portions 21 and 22 can be made from polymethyl methacrylate, polycarbonate or other equivalent materials capable of transmitting light. The upper and lower light guide portions 21 and 22 are coated respectively with a first circuit layer 211 and a second circuit layer 221 facing each other. The first and second circuit layers 211 and 221 are interposed by a command trigger switch 23 corresponding to each keycap 11. Furthermore, the upper light guide portion 21 has a first mask layer 212 opposite to the first circuit layer 211. The lower light guide portion 22 has a second reflective layer 222 opposite to the second circuit layer 221. The first mask layer 212 and second reflective layer 222 form an optical channel 24 between them. The first mask layer 212 also has a transparent zone 213 corresponding to the keycap 11 to allow light transmitted in the optical channel 24 to project to the keycap 11. The first mask layer 212 and second reflective layer 222 are collaborated in implementation so that the light can be reflected by the second reflective layer 222 into the optical channel 24. The first mask layer 212 confines the light to transmit in the optical channel 24 and project to each keycap 11 only through the transparent zone 213. In addition, the first mask layer 212 can make the entire illuminated keyboard to generate uneven illumination effect. Moreover, in order to enhance transmission effect of the optical channel 24, the upper light guide portion 21 can further include a first reflective layer 214 located below the first mask layer 212, and the lower light guide portion 22 can include a second mask layer 223 located below the second reflective layer 222. The mask layers previously discussed can be formed by coating a chemical pigment (such as a black pigment), or a sheet structure made of an opaque material in multiple layers. Furthermore, the light guide circuit board 2 can have a spacer 25 located between the upper light guide portion 21 and lower light guide portion 22 to separate the first circuit layer 211 and the second circuit layer 221 to avoid short circuit from occurring between them. In addition, the spacer 25 has an opening 251 corresponding to each command trigger switch 23. The baseboard 3 is located correspondingly to the light guide circuit board 2 and can be located above or below the light guide circuit board 2, or located between the upper light guide portion 21 and lower light guide portion 22 to replace the spacer 25 previously discussed. Moreover, the illuminated keyboard can further include an elastic buffer member 4 located below the keycap 11, a cap 5 located above the support frame 10 and a lighting unit 26. The lighting unit 26 can be located at one side of the light guide circuit board 2, and can generate light upon being energized to project light into the optical channel 24. Furthermore, the lighting unit 26 can further be located at one side of the first mask layer 212 facing the lower light guide portion 22, or at one side of the second reflective layer 222 facing the upper light guide portion 21. When the lighting unit 26 is located on the first mask layer 212, the upper light guide portion 21 has a first housing trough 215 to hold the lighting unit 26. When the lighting unit 26 is located on the second reflective layer 222, the lower light guide portion 22 has a second housing trough 224 to hold the lighting unit 26.

Figure 8:
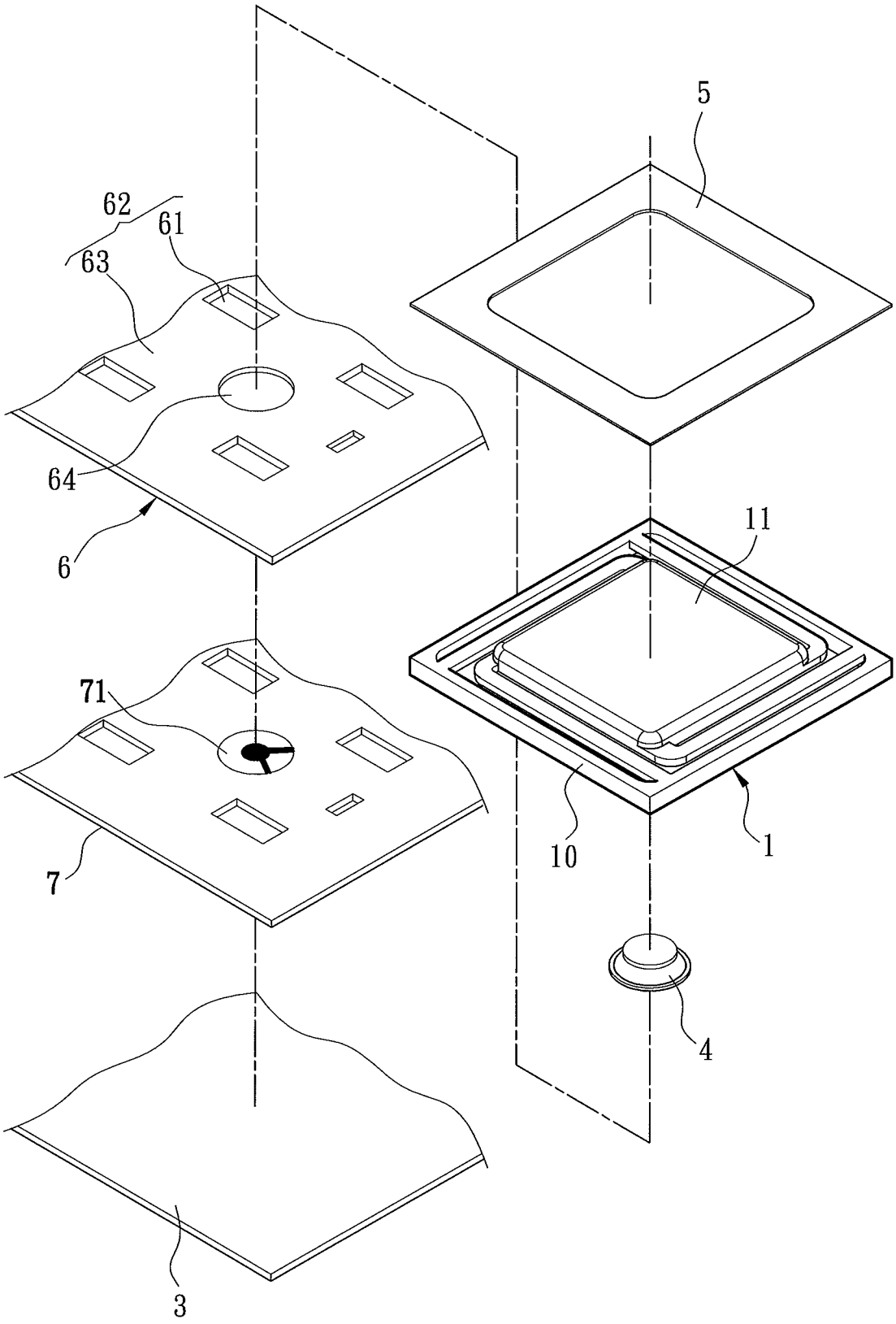
FIG. 8 is an exploded view of a fifth embodiment of the illuminated keyboard according to the invention.
Figure 9:
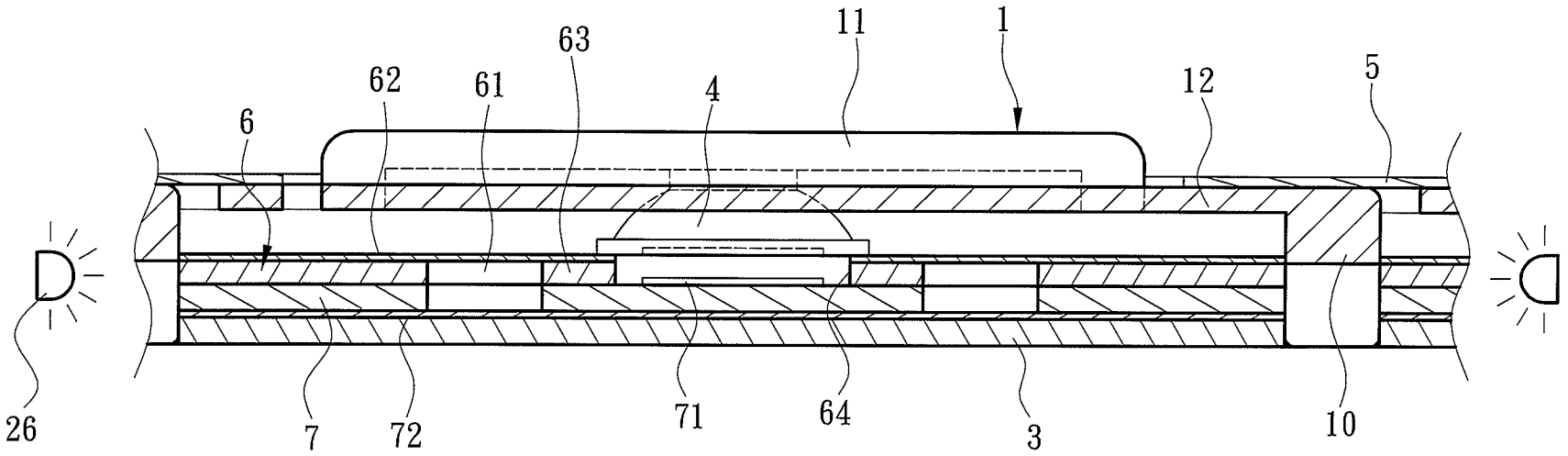
FIG. 9 is a side view of the fifth embodiment of the illuminated keyboard according to the invention.
Figure 10:
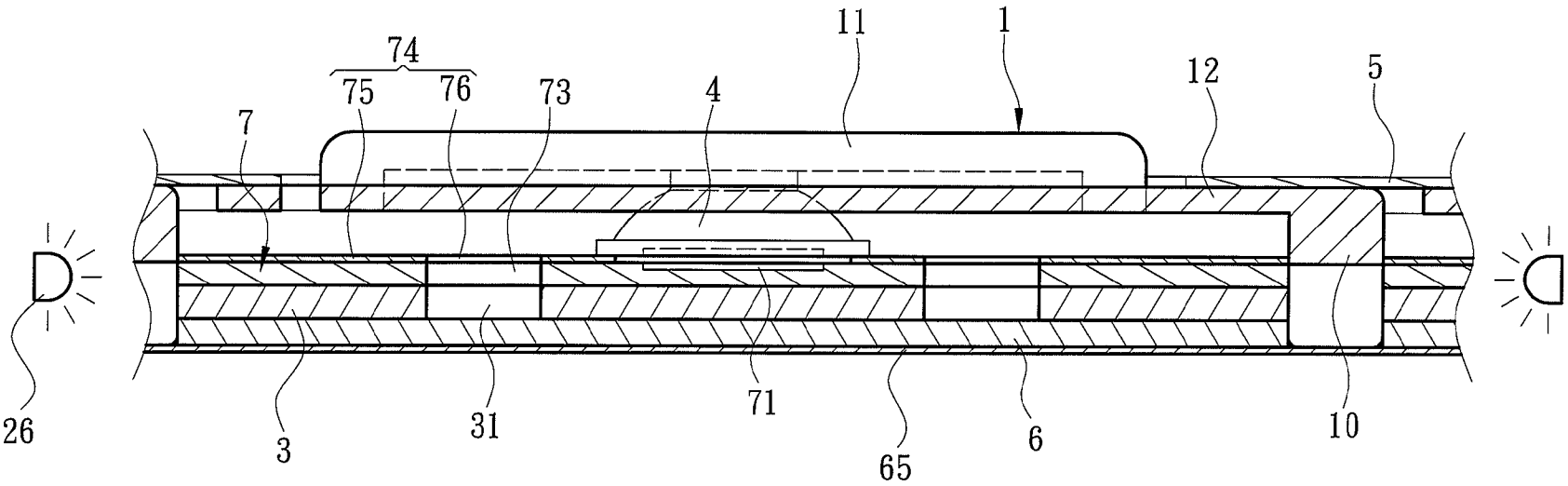
FIG. 10 is a side view of a sixth embodiment of the illuminated keyboard according to the invention.
Figure 11:
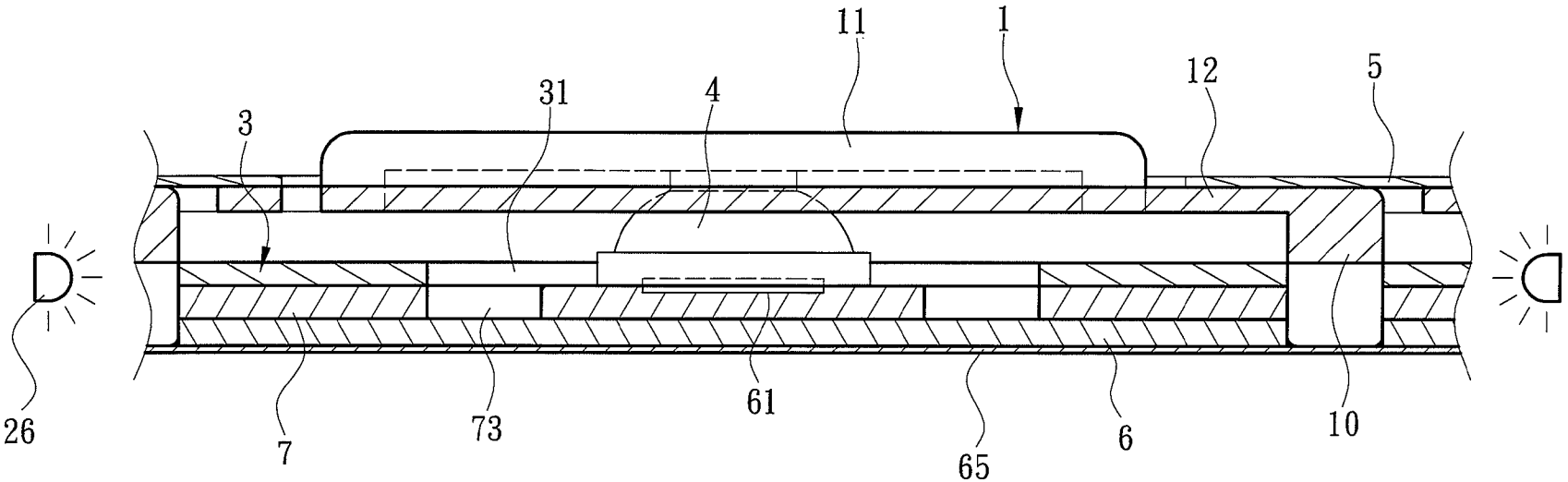
FIG. 11 is a side view of a seventh embodiment of the illuminated keyboard according to the invention.

Please refer to FIGS. 8 and 9 for another embodiment of the invention. The illuminated keyboard comprises a thin key module 1, a light guide plate 6, a circuit board 7 and a baseboard 3. The light guide plate 6 and circuit board 7 are different from the light guide circuit board 2 mentioned in the previous embodiment. The light guide circuit board 2 is a light guide structure with circuitry formed thereon to become an integrated structure. By contrast, the light guide plate 6 and circuit board 7 in this embodiment are two different structures. The light guide plate 6 is located below the thin key module 1 and has a plurality of transparent zones 61 corresponding to the keycaps 11. Light generated by the lighting unit 26 transmits the light guide plate 6 and then projects to each keycap 11 through the transparent zone 61. The circuit board 7 is located correspondingly to the light guide plate 6 and has a plurality of command trigger switches 71 corresponding to the keycaps 11 and triggered individually to generate a keyboard signal. The baseboard 3 is located correspondingly to the circuit board 7. More specifically, in this embodiment, the circuit board 7 is located below the light guide plate 6, and the baseboard 3 is located below the circuit board 7. The light guide plate 6 receives the light from the lighting unit 26 and allows the light to project through the transparent zone 61 to the keycap 11. In addition, the light guide plate 6 has a mask layer 62 located at one side thereof facing the thin key module 1. The light guide plate 6 has the transparent zones 61 and opaque zones 63. The mask layer 62 confines the light transmitted in the light guide plate 6 to project merely through the transparent zones 61. The circuit board 7 has a reflective layer 72 located at one side facing the baseboard 3 to reflect the light to the light guide plate 6. The light guide plate 6 further can have a plurality of connection apertures 64 located in the transparent zones 61 corresponding to the command trigger switches 71. In addition, in this embodiment the circuit board 7, light guide plate 6 and baseboard 3 can be assembled in a sequence desired, not limited to the one discussed in the previous embodiment. Please refer to FIG. 10 for yet another embodiment. In this embodiment the circuit board 7 is located above the light guide plate 6, and the baseboard 3 is located between the circuit board 7 and light guide plate 6. The baseboard 3 has a plurality of light guide apertures 31 corresponding to the command trigger switches 71 (also referring to FIG. 11). The circuit board 7 has a plurality of hollow-out zones 73 corresponding to the keycaps 11. When the light guide plate 6 receives light from the lighting unit 26, the light projects to the keycap 11 through the transparent zone 61, hollow-out zone 73 and light guide aperture 31. In order to enhance light transmission efficiency of the illuminated keyboard, the light guide plate 6 has a reflective layer 65 at one side thereof remote from the baseboard 3. The circuit board 7 also can have a mask layer 74 at one side corresponding to the thin key module 1. The mask layer 74 has a transparent portion 75 and an opaque portion 76 corresponding to each keycap 11. The opaque portion 76 confines the light projection path. The transparent portion 75 allows the light to pass through and project to the keycap 11. Please also refer to FIG. 11 for yet another embodiment in which the circuit board 7 is located below the baseboard 3, and the light guide plate 6 is located below the circuit board 7. The baseboard 3 has a light guide aperture 31 corresponding to each keycap 11. The circuit board 7 has a plurality of hollow-out zones 73 corresponding to the keycaps 11. The light guide plate 6 also has a reflective layer 65 located at one side thereof remote from the circuit board 7. In the embodiments discussed in FIGS. 8 through 11 the lighting unit 26 adopts the one discussed in the previous embodiment, details are omitted herein.

As a conclusion, the invention provides an illuminated keyboard equipped with a thin key module which comprises a support frame with a plurality of keycap installation apertures formed thereon and a plurality of keycaps corresponding to the keycap installation apertures. Each keycap installation aperture and each keycap are bridged by at least three movable arms. The support frame, keycaps and movable arms are integrally formed by injection. Each movable arm has a first connecting section connected to each keycap and a second connecting section connected to the first connecting section at a first bend spot. The second connecting section is extended between the keycap and support frame and connected to the keycap installation aperture. The illuminated keyboard can receive light generated by a lighting unit. The light is transmitted via a light guide plate or a light guide circuit board, and projects to each keycap so that each keycap can be illuminated. The structure of the invention thus formed provides significant improvement to overcome the constraint of the driven mechanism of the conventional illuminated keyboards that makes slimness unattainable.

What is claimed is:

1. An illuminated keyboard, comprising:

a thin key module which includes a support frame with a plurality of keycap installation apertures and a plurality of keycaps corresponding to the keycap installation apertures, each keycap including four sides and four corners, each side of the keycap and each keycap installation aperture including respectively a first wall and a second wall, each keycap including at least three movable arms each being connected between the first wall and the second wall, the keycaps, the movable arms and the support frame being integrally formed by injection, the movable arm including a first connecting section connected to one corner of the keycap and a second connecting section connected to the first connecting section at a first bend spot, the second connecting section being extended towards the neighboring corner of the keycap and connected to the second wall of the keycap installation aperture;

a light guide circuit board which is located below the thin key module and includes an upper light guide portion and a lower light guide portion, the upper light guide portion and the lower light guide portion including respectively a first circuit layer and a second circuit layer facing each other, the first circuit layer and the second circuit layer being interposed by a command trigger switch corresponding to each keycap, the upper light guide portion including a first mask layer opposite to the first circuit layer, the lower light guide portion including a second reflective layer opposite to the second circuit layer, the first mask layer and the second reflective layer forming an optical channel between them, the first mask layer including at least one transparent zone corresponding to the keycap to allow light transmitted in the optical channel to project to the keycap; and a baseboard located correspondingly to the light guide circuit board.

2. The illuminated keyboard of claim 1, wherein the upper light guide portion includes a first reflective layer located below the first mask layer.

3. The illuminated keyboard of claim 1, wherein the lower light guide portion includes a second mask layer located below the second reflective layer.

4. The illuminated keyboard of claim 2, wherein the lower light guide portion includes a second mask layer located below the second reflective layer.

5. The illuminated keyboard of claim 1, wherein the light guide circuit board includes a spacer located between the upper light guide portion and the lower light guide portion, the spacer including an opening corresponding to the command trigger switch.

6. The illuminated keyboard of claim 1, wherein the light guide circuit board is located above the baseboard.

7. The illuminated keyboard of claim 1, wherein the light guide circuit board is located below the baseboard.

8. The illuminated keyboard of claim 1, wherein the movable arm includes a third connecting section connected to the second connecting section at a second bend spot and connected to the second wall of the keycap installation aperture.

9. An illuminated keyboard, comprising:

a thin key module which includes a support frame with a plurality of keycap installation apertures and a plurality of keycaps corresponding to the keycap installation apertures, each keycap including four sides and four corners, each side of the keycap and each keycap installation aperture including respectively a first wall and a second wall, each keycap including at least three movable arms each being connected between the first wall and the second wall, the keycaps, the movable arms and the support frame being integrally formed by injection, the movable arm including a first connecting section connected to one corner of the keycap and a second connecting section connected to the first connecting section at a first bend spot, the second connecting section being extended towards the neighboring corner of the keycap and connected to the second wall of the keycap installation aperture;

a light guide plate which is located below the thin key module and includes a plurality of transparent zones corresponding to the keycaps, and receives light generated by a lighting unit and allows the light to project to the keycaps through the transparent zones;

a circuit board corresponding to the light guide plate and including a plurality of command trigger switches corresponding to the keycaps, each command trigger switch being triggered to generate a keyboard signal; and a baseboard corresponding to the circuit board.

10. The illuminated keyboard of claim 9, wherein the circuit board is located below the light guide plate and the baseboard is located below the circuit board.

11. The illuminated keyboard of claim 10, wherein the light guide plate includes a plurality of connection apertures corresponding to the command trigger switches and located in the transparent zones.

12. The illuminated keyboard of claim 10, wherein the light guide plate includes a mask layer located at one side thereof facing the thin key module to allow the light guide plate to have the transparent zones and opaque zones.

13. The illuminated keyboard of claim 10, wherein the circuit board includes a reflective layer located at one side thereof facing the baseboard to reflect the light to the light guide plate.

14. The illuminated keyboard of claim 9, wherein the circuit board is located above the light guide plate and the baseboard is located between the circuit board and the light guide plate.

15. The illuminated keyboard of claim 14, wherein the baseboard includes a plurality of light guide apertures corresponding to the command trigger switches.

16. The illuminated keyboard of claim 14, wherein the circuit board includes a plurality of hollow-out zones corresponding to the keycaps.

17. The illuminated keyboard of claim 15, wherein the circuit board includes a plurality of hollow-out zones corresponding to the keycaps.

18. The illuminated keyboard of claim 14, wherein the circuit board includes a mask layer located at one side thereof facing the thin key module, the mask layer including a plurality of transparent portions corresponding to the keycaps and a plurality of opaque portions connected to the transparent portions.

19. The illuminated keyboard of claim 14, wherein the light guide plate includes a reflective layer located at one side thereof remote from the baseboard.

20. The illuminated keyboard of claim 18, wherein the light guide plate includes a reflective layer located at one side thereof remote from the baseboard.

21. The illuminated keyboard of claim 9, wherein the circuit board is located below the baseboard and the light guide plate is located below the circuit board.

22. The illuminated keyboard of claim 21, wherein the baseboard includes a plurality of light guide apertures corresponding to the keycaps.

23. The illuminated keyboard of claim 21, wherein the circuit board includes a plurality of hollow-out zones corresponding to the keycaps.

24. The illuminated keyboard of claim 22, wherein the circuit board includes a plurality of hollow-out zones corresponding to the keycaps.

25. The illuminated keyboard of claim 21, wherein the light guide plate includes a reflective layer located at one side thereof remote from the circuit board.

26. The illuminated keyboard of claim 9, wherein the movable arm includes a third connecting section connected to the second connecting section at a second bend spot and connected to the second wall of the keycap installation aperture.

* * * * *